US006638601B1

(12) United States Patent
Follensbee

(10) Patent No.: US 6,638,601 B1
(45) Date of Patent: Oct. 28, 2003

(54) COATED ABRASIVE HAVING LAMINATE BACKING MATERIAL AND METHOD OF MAKING THE SAME

(76) Inventor: Robert A. Follensbee, P.O. Box 33427, St. Paul, MN (US) 55133-3427

( * ) Notice: Subject to any disclaimer, the term of this patent is extended or adjusted under 35 U.S.C. 154(b) by 202 days.

(21) Appl. No.: 09/687,376

(22) Filed: Oct. 13, 2000

(51) Int. Cl.[7] ..... B32B 5/16

(52) U.S. Cl. ..... 428/143; 428/149; 428/150; 442/394; 442/385; 442/412; 51/297

(58) Field of Search ..... 428/143, 149, 428/150; 51/297; 442/394, 385, 412

(56) References Cited

U.S. PATENT DOCUMENTS

| | | | |
|---|---|---|---|
| 4,240,807 A | | 12/1980 | Kronzer |
| 4,314,827 A | | 2/1982 | Leitheiser et al. |
| 4,652,275 A | | 3/1987 | Bloecher et al. |
| 4,744,802 A | | 5/1988 | Schwabel |
| 4,770,671 A | | 9/1988 | Monroe et al. |
| 4,881,951 A | | 11/1989 | Monroe et al. |
| 4,903,440 A | | 2/1990 | Larson et al. |
| 5,236,472 A | | 8/1993 | Kirk et al. |
| 5,286,541 A | | 2/1994 | Darjee et al. |
| 5,766,277 A | * | 6/1998 | DeVoe et al. ..... 51/295 |
| 5,975,988 A | | 11/1999 | Christianson |
| 6,066,188 A | | 5/2000 | Benedict et al. |

FOREIGN PATENT DOCUMENTS

| | | |
|---|---|---|
| DE | 18 12 776 A | 7/1969 |
| DE | 36 20 570 A | 12/1987 |
| EP | 0 587 171 A | 3/1994 |
| EP | 0 590 670 A | 4/1994 |
| EP | 0 716903 A1 | 12/1995 |
| GB | 1 451 331 A | 9/1976 |
| WO | WO 93 15879 A | 8/1993 |

OTHER PUBLICATIONS

Patent application with Ser. No. 09/219,289, filed Dec. 22, 1998 (Follensbee et al.).

* cited by examiner

*Primary Examiner*—William P. Watkins, III

(57) ABSTRACT

The invention provides coated abrasive products having as a backing material a barrier-coated tear-resistant laminate of fabric and paper overcoated on the barrier coating with an abrasive coating. The coated abrasive product is made by laminating at least one fabric sheet and at least one paper sheet with adhesive to provide a laminate having at least one major surface provided by the fabric sheet, coating the surface of the fabric with a barrier coating and coating the barrier coated surface with an abrasive layer.

17 Claims, 4 Drawing Sheets

COATED ABRASIVE HAVING LAMINATE BACKING MATERIAL AND METHOD OF MAKING THE SAME

FIELD OF THE INVENTION

This invention relates to tear-resistant coated abrasive products and, more particularly, to coated abrasive products that have as a backing material a barrier-coated tear-resistant laminate of fabric and paper and to a method of making the coated abrasive product.

BACKGROUND OF THE INVENTION

Coated abrasive products have been used for at least a century to finish the surfaces of various substrates such as wood, metal, plastic and composite materials. Coated abrasive products typically comprise a flexible backing material which is overcoated with an abrasive layer comprised of abrasive particles and a cured binder material. It is customary to make some coated abrasives by application of a make or maker coat of a binder material to the backing, application of abrasive particles to the make coat while it is sufficiently tacky to adhere to the abrasive particles and then overcoating the make coat containing the abrasive particles with a size coating. The make coating may be partially cured prior to application of the size coating but once the size coating is applied, it is typical to fully cure both the make and size coating so that the resultant coated abrasive product can be employed as an abrasive material. It is sometimes customary to flex the resultant coated abrasive product to impart cracks in the abrasive layer to provide suitable flexibility for the coated abrasive product. Thereafter, the coated abrasive material is converted into various abrasive products, e.g., rectangular sandpaper sheets, circular abrasive discs, or abrasive belts typically by cutting a strip of the coated abrasive product and joining the ends of the strip to provide an endless belt.

Any of a variety of backing materials have been used in the manufacture of coated abrasive products. The selection of backing material is typically made based upon the intended use of the product. Material such as paper, fabric (either nonwoven or woven) plastic film or combinations of these materials have been employed.

Paper backings for coated abrasive products are preferred for many applications because of their relatively stiff, but flexible nature, which makes them suitable for use as coated abrasive sheets, abrasive discs and abrasive belts. Paper, however, has a relatively low tensile strength at break which may cause a coated abrasive product with a paper backing to fail prematurely before its abrasive surface is fully utilized. This is particularly true when the abrasive granules are of a coarser nature which transmits greater stress to the backing as the abrasive product is being employed, particularly as an abrasive disc or abrasive belt.

Other problems encountered with paper backings include surface roughness, particularly where finer abrasive particles are employed and, in the case of abrasive discs, edge chipping where the bond between the paper substrate and the make coat fails before the abrasive coating has been fully used.

A solution to the surface roughness problem is proposed by Darjee, et al. in U.S. Pat. No. 5,286,541. This patent teaches the use of a combination backing for coated abrasive products which includes a flexible paper member having an ionomer film layer adhered to its top surface to which the make coat is adhered to provide a smooth surface to the backing.

European Patent Application No. 0 716 903 A1 discloses a backing material made of a nonwoven fiber mat which is reinforced to form a flat plane wear- and tear-resistant substrate by means of a binder or by superficial dissolving or fusing of the fibers which may be further reinforced by laminating a reinforcing fabric to its backside. This backing does not include paper and, thus, its use would not have the benefits of having a paper backing for a coated abrasive product.

It is known to use commercially available laminates such as the cylinder paper/cloth fabric laminate sold by McKenzie Coating and Finishing Company, Hyde, United Kingdom as a backing for coated abrasives. This laminate is typically provided with an abrasive coating over the cloth side but without first coating the fabric side with a barrier coating. The absence of a barrier coating allows penetration by the liquids in the curable make coating composition into the fibers of the cloth fabric which tends to embrittle the fibers and weaken the laminate. Moreover, even if this laminate were used as a coated abrasive backing with a barrier coat, the resultant backing would not have the needed tear strength in the cross direction to meet the requirements needed to provide a tear resistant coated abrasive product.

Thus, a need exists for a backing for a coated abrasive product which has sufficient tear strength to be utilized in disc and belt applications under any of a variety of conditions which also has the beneficial properties of a paper backing to provide a backing which is relatively stiff, but flexible.

SUMMARY OF THE INVENTION

This invention provides a coated abrasive product which includes an abrasive layer applied to a backing comprised of a laminate of paper and fabric. The backing is relatively stiff, but flexible, and has sufficient tear strength to be employed under any of a wide variety of applications including use in abrasive discs and in abrasive belts. The coated abrasive products of the invention also have a backing caliper that is significantly more uniform than their cloth-backed comparatives.

Specifically, the invention provides a coated abrasive product comprising:

a. an abrasive layer;

b. a barrier coating; and c. a relatively stiff, but flexible, backing comprising at least one fabric sheet and at least one paper sheet adhesively laminated together by an adhesive material to provide a laminate having at least one major surface provided by said fabric sheet that is coated with said barrier coating to which said abrasive layer is adhered and a second opposite major surface provided by said paper sheet, wherein the backing has an Elmendorf tear test value in the cross direction of at least about 10,000 mN.

Preferred coated abrasive products of the present invention have an Elmendorf tear test value in their cross direction of at least 6000 mN.

As used herein, the following definitions shall apply:

An "abrasive layer" refers to a layer comprised of abrasive particles adhered within or to a cured binder coating.

A "fabric" refers to a woven or nonwoven fabric formed as an integral sheet of fibers that are either woven together or bonded together either by a binder or, in the case of thermoplastic fibers, by heat and/or pressure, solvent treatment or by other methods without adhesive.

A "barrier layer" refers to a layer of a cured composition which has an initial liquid state which will penetrate the fabric sheet and in the liquid state is a non-fiber embrittling coatable composition comprised of binder in solution or in a dispersion which, on curing, results in a cured composition that is substantially impervious to subsequent liquid-based coatings applied thereover.

A "non-fiber-embrittling coatable composition" is a coatable composition that has ingredients which have only a minimal or no embrittling effect on the fibers of the fabric sheet.

A "spunbonded fabric" refers to a fabric formed of filaments that have been extruded, drawn, laid on a continuous belt and then immediately bonded.

The fabric sheet may be a woven cloth, but preferably it is a nonwoven fabric such as a spunbonded nonwoven web. The fabric preferably has a thickness of about 0.1 to about 0.4 mm. The fabric preferably has a basis weight in the range of about 17 to 230 grams per square meter (gsm). Useful cloth fabrics have a tensile strength at break of at least about 50 kg/25 mm.

The backing may include a second fabric sheet adhesively laminated to its second opposite major surface to provide further reinforcement of the backing. This is particularly desirable where large abrasive granules are to be employed in the abrasive layer or for high throughput grinding. The second fabric may be a woven fabric, like the first fabric, but preferably is a nonwoven fabric such as a spunbonded nonwoven web.

The adhesive material employed to laminate the fabric to the paper is preferably a thermoplastic adhesive such as an ionomer adhesive material and, most preferably, is a zinc salt of ethylene methacrylic acid copolymer.

Any of a variety of papers customarily employed as coated abrasive backings may be employed to provide the paper sheet. Preferably, the paper sheet is a cylinder paper which preferably has a basis weight in the range of about 100 to 400 gsm. Useful papers preferably have a machine direction tensile strength at break of at least about 40 kg/25 mm and in the cross direction of at least about 16 kg/25 mm.

The barrier coating composition is preferably a reactive acrylic latex with carboxyl functionality which cures to provide a crosslinked acrylic resin.

Most preferably, where the coated abrasive product is to be utilized for finishing wood products where charged particulate airborne wood particles are generated, additives may be included to make the coated abrasive product electrically conductive to dissipate the electrical charge. Such additives may be added to the barrier coating composition, for example, in the form of carbon black particles or to the paper, in the form of short carbon filament segments.

The invention further provides a method of making the coated abrasive product. The method comprises the following steps:

a. laminating under pressure a fabric sheet to a paper sheet with an adhesive composition to provide a relatively stiff, but flexible, backing having at least one major surface provided by the fabric sheet and a second opposite major surface provided by said paper sheet, said backing having an Elmendorf tear test value in the cross direction of at least about 10,000 mN;

b. coating said one major surface of said backing with a non-fiber-embrittling curable barrier coating composition;

c. curing said barrier coating composition; and d. coating said barrier coated major surface of said backing with an abrasive coating.

The preferred method of providing the abrasive coating is by:

a. applying a make coat to said barrier coated major surface of said backing;

b. applying abrasive granules to the make coat before it is fully cured;

c. at least partially curing the make coating;

d. applying a size coating to the abrasive granule coated make coat; and e. fully curing the make and size coats.

The coated abrasive product may be converted by utilizing conventional techniques into coated abrasive belts, coated abrasive discs and rectangular coated abrasive sheets.

BRIEF DESCRIPTION OF DRAWINGS

The invention is further illustrated by reference to the following drawings wherein.

DETAILED DESCRIPTION

Figure 1:
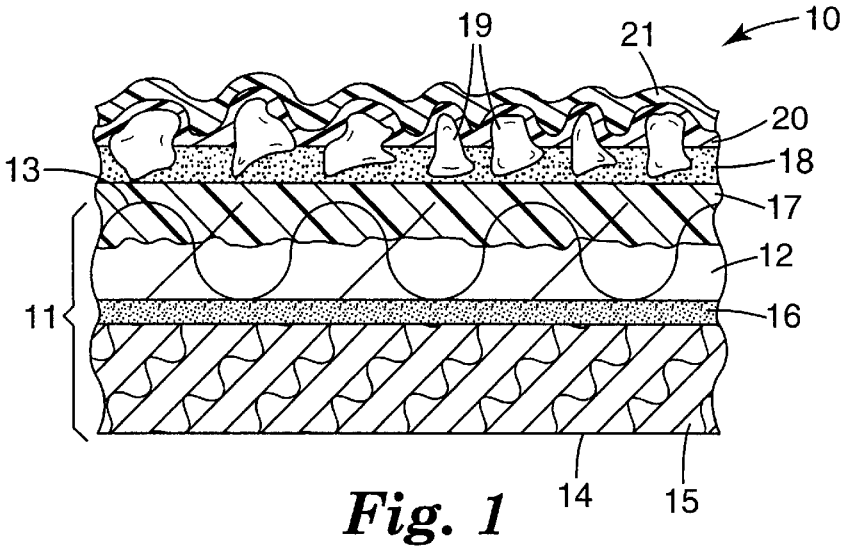
FIG. 1 is an enlarged side cross-sectional view of a segment of a coated abrasive product according to the present invention.

Referring now to FIG. 1 of the drawing, there is shown a cross-sectional view of a coated abrasive product 10 which comprises a backing in the form of laminate 11 comprised of fabric 12 which has a top surface 13 and a bottom surface which is laminated to paper sheet 15 by laminating adhesive 16 to provide laminate 11 with top surface 13 and bottom surface 14. It will be understood that there will be some penetration of adhesive 16 into sheets 12 and 15, respectively, depending on their porosity. The top surface 13 of the laminated backing 11 is sealed with a barrier coat 17 to which is adhered an abrasive layer. Barrier coat 17 will penetrate into the top surface 13 of fabric sheet 12 to coat any surface fibers therein, providing a barrier for subsequent coating compositions applied to upper surface 13 to prevent fiber embrittlement. The abrasive layer may be a conventional coated abrasive layer provided by a make coat adhesive layer 18 in which is partially embedded a plurality of abrasive particles 19 having an overcoating of a size adhesive layer 20 and optionally a supersize adhesive layer 21 which may include certain functional materials such as a grinding aid. Alternatively, the abrasive layer may be provided by a slurry of abrasive particles in a curable binder which is merely coated onto barrier coat 17 or coated and shaped onto barrier coat 17 by any of a variety of known techniques.

Figure 2:
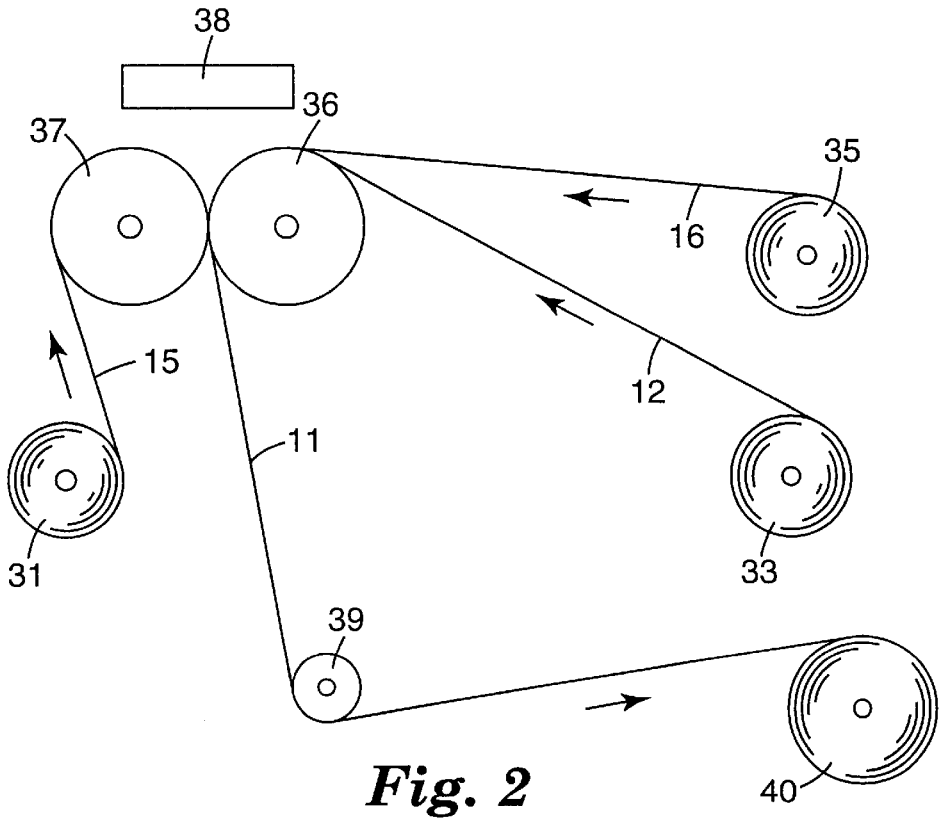
FIG. 2 is a schematic diagram depicting a method of making the laminated backing for the coated abrasive product depicted in FIG. 1.
Figure 3:
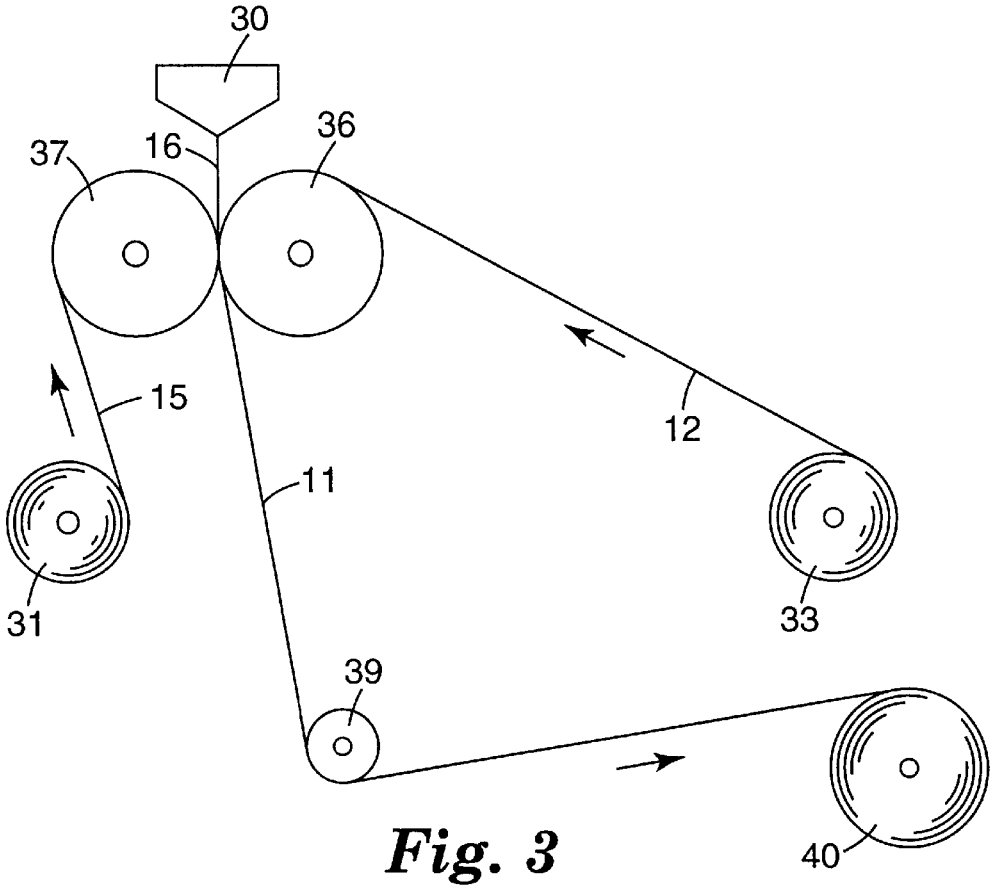
FIG. 3 is another schematic diagram depicting an alternative method of making the laminated backing of the coated abrasive depicted in FIG. 1.
Figure 4:
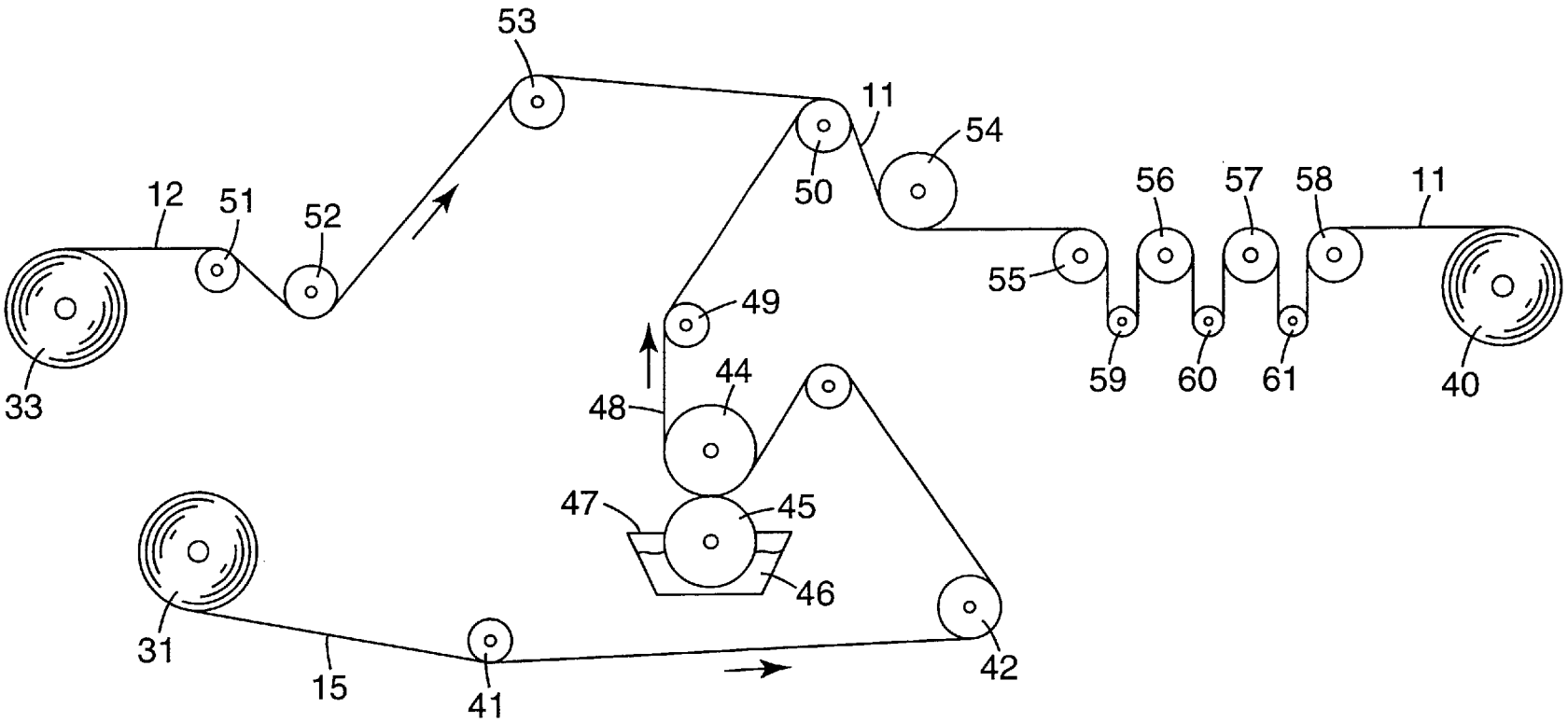
FIG. 4 is a schematic diagram depicting a further method of making the laminated backing of the coated abrasive product depicted in FIG. 1.

The backing 11 may be made by any of a variety of processes schematically depicted in FIGS. 2–4. Referring to FIG. 2, a process is schematically depicted wherein paper 15 is unwound from roll 31, fabric 12 is simultaneously unwound from roll 33 and adhesive material 16 in the form of a preformed sheet is simultaneously unwound from roll 35 with each of paper 15, fabric 12 and adhesive material 16 being simultaneously fed into the nip between laminating rolls 36 and 37 which are spaced in close proximity to cause lamination. Heater 38 is positioned above the nip between rolls 36 and 37 to preheat adhesive film 16 before it enters the nip. At least one of rolls 36 and 37 is heated to a laminating temperature, to melt adhesive material 16 and cause lamination of the paper to the fabric thereby producing laminate 11 which is conducted over chill roll 39 to harden the thermoplastic adhesive material and then wound on storage roll 40 for future use as a coated abrasive backing.

Referring now to FIG. 3 wherein reference numerals that are the same as shown in FIGS. 1 and 2 refer to the same items, there is shown an alternative method of making laminate 11. In the same manner as shown in FIG. 2, FIG. 3 shows paper 15 being unwound from storage roll 31 simultaneously as fabric 12 is unwound from storage roll 33. Thermoplastic material which forms the laminating adhesive is extruded as film 16 from extruder 30. Each of paper 15, fabric 12 and extruded adhesive film 16 moving at the same rate simultaneously converge at and are drawn into the nip between adjacent heated rolls 36 and 37, respectively, to produce laminate 11 which is conducted over chill roll 39 to harden the adhesive and then conducted to storage roll 40 where laminate 11 is wound for future use as a coated abrasive backing.

The extruder shown in FIG. 3 may be any conventional extruder capable of providing extruded films of the adhesive material. A suitable extruder for this purpose is a 20 mm single screw extruder having 4 heated zones available under the trade designation Berlyn™ extruder from Berlyn Extruders Inc., Worcester, Mass. p FIG. 4 shows yet another alternative process for making laminate 11. In FIG. 4, fabric 12 is unwound from storage roll 33 simultaneously as paper 15 is unwound from storage roll 31. Paper 15 is conducted over idler rolls 41, 42 and 43, respectively, where it is coated between back-up roll 44 and coater roll 45 which takes a coatable curable adhesive composition 46 from reservoir 47 to provide coated paper 48 which is conducted over idler roll 49 and directed to roll 50. Simultaneously fabric 12 is conducted over idler rolls 51, 52 and 53, respectively, and also directed to roll 50 where fabric 12 and coated paper 48 merge with the adhesive coating between fabric 12 and coated paper 48 providing laminate 11 which is conducted over idler roll 54 and then over a series of 4 hot can rollers 55, 56, 57 and 58, respectively, having interposed between each adjacent hot can roller idler rolls 59, 60 and 61, respectively. Hot can rollers preferably are steel with a fabric sleeve, with roll 55 being heated at 88° C. (190° F.), roll 56 being heated at 93° C. (200° F.) and rolls 57 and 58 being heated at 99° C. (210° F.), respectively. Thereafter, laminate 11 is wound onto storage roll 40 for future use as a coated abrasive backing. A preferred adhesive coating composition for use in this process comprises an emulsion composition of approximately 99 parts by weight Carbobond™ 26373 acrylic emulsion and 1 part by weight Carbopol™ EP-1, both sold by B. F. Goodrich and Company, Cleveland, Ohio. This emulsion has 57.5% solids and a viscosity of 1800–2800 cP @ 25° C. (see Table 1).

The laminate 11 is sufficiently tear-resistant to be employed in any of a variety of abrasive products such as abrasive discs and abrasive belts. Useful backings before being coated with the barrier coating are characterized by having an Elmendorf tear test value of at least about 10,000 mN.

The coating part of the process depicted in FIG. 4 may also be employed to apply the barrier coat, in which case the fabric 12 would be omitted.

Laminate 11 may then be coated by any of a variety of conventional techniques with a barrier coating over the top surface of fabric 12 to provide a surface 13 on which an abrasive layer will be coated. Functionally stated, the amount of barrier coating material on the fabric side of the laminate is that sufficient to protect the surface layer of fibers of the fabric from penetration of subsequent make coating compositions. Useful dry coating weights will typically vary between about 30 g/m$^2$ to about 80 g/m$^2$, preferably about 40 g/m$^2$ to about 70 g/m$^2$. The coating of the barrier coating material may involve any of a variety of known techniques such as roll coating, spray coating, extrusion coating, knife coating, Mayer bar coating, dip coating, etc. The barrier coat is then cured by techniques applicable for the particular coating composition selected to provide a cured coating onto which the abrasive layer will be formed.

Figure 5:
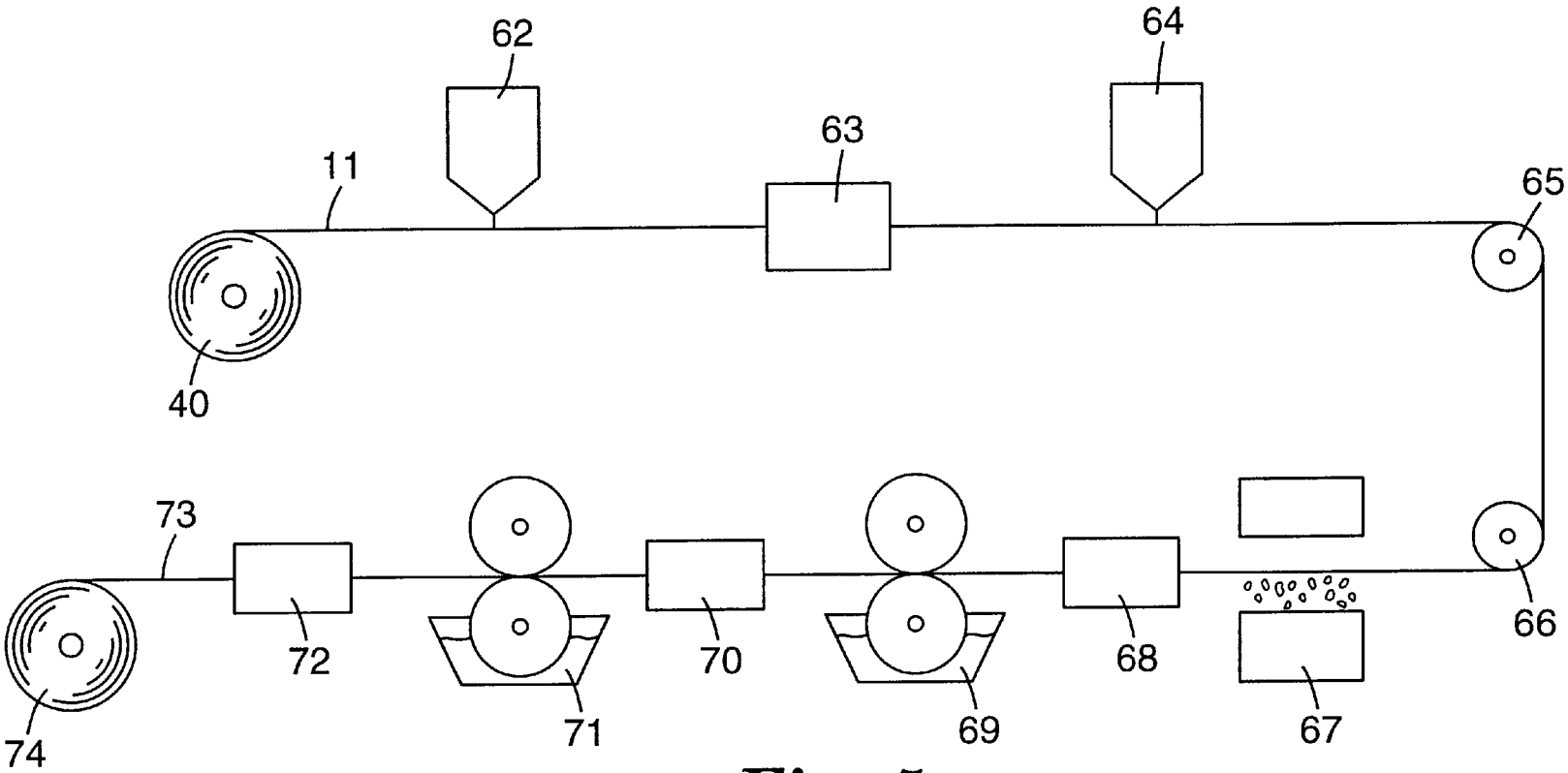
FIG. 5 is a schematic diagram depicting a method of making the coated abrasive product depicted in FIG. 1.

The technique of forming the abrasive layer is well known in the prior art and will be explained later in greater detail. Referring now to FIG. 5 of the drawing, there is shown a schematic diagram of a process for making a coated abrasive product utilizing the laminate backing described above. It should be understood that FIG. 5 shows a continuous process for making the coated abrasive which is provided merely for convenience to show the typical steps. The coated abrasive is almost never made in such a continuous process and each of the steps is typically carried out separately. Further, certain conventional steps are not shown in FIG. 5. These include flexing the coated abrasive and humidifying the coated abrasive. These steps are described in more detail later.

Referring to FIG. 5, the laminate backing 11 is unwound from storage roll 40 and passed beneath an appropriate coater 62 such as a Mayer bar coater for application thereon of the barrier coating composition. The barrier coating composition is cured by passing the coated laminate through an appropriate curing oven 63. Following conventional steps thereafter, a make coating composition is applied to the barrier coated laminate by an appropriate coating device 64 such as a roll coater. Thereafter, the make coated laminate is conducted through an abrasive granule deposition station 67 such as a device where abrasive particles are propelled in an electrostatic field up to the uncured make coating where they are typically deployed in an erect deployment and thereafter passed through a curing oven 68 to at least partially cure the make coat and then through a coating station 69 such as a roll coat set where a size coating is applied and then through a curing oven 70. Then, the size coated product is optionally passed through a supersize coating station 71 followed by curing in an appropriate oven 72, producing coated abrasive product 73 25 which is wound on a storage roll for future conversion to particular coated abrasive products. Thereafter, roll 74 of coated abrasive product is typically stored at about 60° C. in a chamber having a relative humidity of about 35–50%, typically for about 2 hours to reintroduce moisture into the product. The resulting coated abrasive product is then typically single flexed by passing it over a 1.5 inch (3.8 cm) diameter roller at an angle of 90° C. to impart controlled cracking to the make and size coatings. The coated abrasive product may be converted by conventional means to any other variety of conventional coated abrasive products such as an abrasive disc, an abrasive belt or rectangular abrasive sheets in sizes and shapes which are commonplace in the coated abrasive industry.

The coated abrasive products may then be modified by any of a variety of ways including fastening on the backs of abrasive discs, suitable attachment devices such as one part of a hook and loop engaging fabric or a film bearing erect filaments with flattened distal ends which are capable of engaging a mating fabric which may be applied on the rotatable back-up pad of an appropriate tool.

The fabric portion of the backing may either be a nonwoven fabric such as a spun bond nonwoven fabric or a woven fabric. The preferred fabric is a spunbonded fabric. The paper sheet material 15 may comprise any of a variety of known papers utilized as backing materials for coated abrasive products. The preferred paper for this purpose is a cylinder paper. Cylinder paper is a multiple ply paper web which is formed by collecting and pressing the individual plies, each formed in its own vat containing a pulp slurry and rotating cylinder. Each cylinder has a screened covering which picks up a layer of fibers from which it is transferred to a felt that carries it to the next cylinder vat. The plies are successively built up, the number of which corresponds to the number of cylinder vats on the multicylinder machine.

Any of a variety of papers customarily employed as coated abrasive backings may be employed to provide the paper sheet. Preferably, the paper sheet is a cylinder paper which preferably has a basis weight in the range of about 100 to 400 gsm. Useful papers preferably have a machine direction tensile strength at break of at least about 40 kg/25 mm and in the cross direction of at least about 16 kg/25 mm. A preferred cylinder paper is that having a basis weight of 220 g/m$^2$ commercially available from FiberMark, Battleboro, Vt.

The fabric sheet may be a woven cloth, but preferably it is a nonwoven fabric such as a spunbonded nonwoven web. The fabric preferably has a thickness of about 0.1 to about 0.4 mm. The fabric preferably has a basis weight in the range of about 17 to 230 grams per square meter (gsm). Useful cloth fabrics have a tensile strength at break of at least about 50 kg/25 mm.

Useful nonwoven fabrics include a fiber-reinforced paper available from Kimberly-Clark Corporation, Munising, Mich. sold as type S-88982 red abrasive belt paper backing having a basis weight of 248 g/m$^2$, nylon spunbonded web having a basis weight of 68 g/m$^2$ available under the trade designation CEREX™ 2320 from Cerex Advanced Fabrics, Pensacola, Fla. and pointbonded nylon spunbonded web having a basis weight of 68 g/m$^2$ available under the trade designation ORION™ fabric from Cerex Advanced Fabrics, Pensacola, Fla. A combination backing useful as one component of laminate 11 in the present invention is a cloth/paper combination web having a basis weight of 390 g/m$^2$ and an Elmendorf tear test value in the cross direction of 9400 mN. The combination web is available from McKenzie Coating and Finishing Co., Hyde, United Kingdom. This combination web has insufficient cross direction tear strength to make it useful as a tear-resistant backing per se but once it is laminated to an additional spunbonded fabric, a suitable laminate is produced.

Adhesive materials which may be utilized for laminating adhesive 16 include a thermoplastic ionomer available under the trade designation SURLYN™ 1652 from the E. I. DuPont DeMours Company, Wilmington, Del. An emulsion adhesive composition useful for laminating and as a barrier coating composition is a blend of 99 parts by weight of a heat-reactive self-curing acrylic latex with carboxyl functionality available under the trade designation Carbobond™ 26373 and 1 part by weight a high-efficiency, alkali-swellable emulsion thickener available under the trade designation Carbopol™ EP-1, both components being available from B. F. Goodrich Company, Cleveland, Ohio. The resultant emulsion has 57.5% solids and a viscosity of 1800–2800 cP @ 25° C. and is a reactive acrylic latex with carboxyl functionality which cures to provide a crosslinked acrylic resin.

The laminate 11 forming the backing of the coated abrasive product of the invention may also be made by coating a liquid coating composition onto one of the fabric or paper elements to be laminated together by a suitable coating technique such as roll coating and then laminating the elements together under heat and pressure to cure the laminating adhesive to provide the desired laminate.

The laminate has greater tear strength than paper alone because of the presence of the fabric element, yet it is considerably less expensive than a 100% fabric backing because of the relatively inexpensive paper element. The laminate, and a coated abrasive, also provides more desirable performance properties when compared to 100% paper as a backing for a coated abrasive product.

Abrasive Coating

The invention provides coated abrasive products comprising an abrasive layer coated on a barrier coated laminated fabric/paper backing. The abrasive layer can be provided by any known means, i.e., drop coating, slurry coating, electrostatic coating, roll coating, etc. The abrasive coating is applied to the side of the backing having the barrier coating over the fabric side of the laminate.

Once the backing is formed, the introduction of abrasive particles and several adhesive layers, which are typically applied in binder precursor form, is contemplated in the context of forming the abrasive layer of the coated abrasive product.

Make Coat

A make coat is applied to the barrier coated fabric side of the backing. The make coat binder precursor can be coated by any conventional technique, such as knife coating, spray coating, roll coating, rotogravure coating, and the like.

The adhesive layers in the coated abrasive articles of the present invention used variously as make, size and supersize coats, typically are formed from a resinous adhesive. Each of the layers can be formed from the same or different resinous adhesives. Useful resinous adhesives are those that are compatible with the organic polymeric material of the barrier coating. Cured resinous adhesives are also tolerant of grinding conditions such that the adhesive layers do not deteriorate and prematurely release the abrasive material.

The resinous adhesive is preferably a layer of a thermosetting resin. Examples of useable thermosetting resinous adhesives suitable for this invention include, without limitation, phenolic resins, aminoplast resins, urethane resins, epoxy resins, acrylate resins, acrylated isocyanurate resins, urea-formaldehyde resins, isocyanurate resins, acrylated urethane resins, acrylated epoxy resins, or mixtures thereof.

Preferably, the thermosetting resin adhesive layers contain a phenolic resin, an aminoplast resin, or combinations thereof. The phenolic resin is preferably a resole phenolic resin. Examples of commercially available phenolic resins include those available under the trade designations VARCUM™ from OXY Chem Corporation, Dallas, Tex.; AROFENE™ from Ashland Chemical Company, Columbus, Ohio; and BAKELITE™ from Union Carbide, Danbury, Conn. A preferred aminoplast resin is one having at least one pendant alpha, beta-unsaturated carbonyl groups per molecule, which is made according to the disclosure of U.S. Pat. Nos. 4,903,440 (Larson, et al.) or 5,236,472 (Kirk, et al.), each of which is incorporated herein by reference.

The make, size coats and supersize layers, respectively, can preferably contain other materials that are commonly utilized in coated abrasive products. These materials, referred to as additives, include grinding aids, fillers, coupling agents, wetting agents, dyes, pigments, plasticizers, release agents, or combinations thereof One would not typically use more of these materials than needed for desired results. Fillers are typically present in no more than an amount of about 90 wt %, for either the make or size coat, based upon the weight of the adhesive. Examples of useful fillers include calcium salts, such as calcium carbonate and calcium metasilicate, silica, metals, carbon, or glass.

Preferably, the adhesive layers, at least the make, size coat and supersize layers, respectively, are formed from a calcium metasilicate filled resin treated with a silane coupling agent, such as resole phenolic resin, for example. Resole phenolic resins are preferred at least because of their heat tolerance, toughness, high hardness, and low cost. More preferably, the adhesive layers include about 50–90 wt % silane treated calcium metasilicate in a resole phenolic resin.

Abrasive Particles

The abrasive particles suitable for this invention include fused aluminum oxide, heat treated aluminum oxide, ceramic aluminum oxide, silicon carbide, alumina zirconia, garnet, diamond, cubic boron nitride, titanium diboride, or mixtures thereof The abrasive particles can be either shaped (e.g., rod, triangle, or pyramid) or unshaped (i.e., irregular). The term "abrasive particle" encompasses abrasive grains, agglomerates, or multi-grain abrasive granules. Examples of such agglomerates are described in U.S. Pat. No. 4,652,275 (Bloecher, et al.) and U.S. Pat. No. 5,975,988 (Christianson) and assigned to the assignee of the present invention. The agglomerates can be irregularly shaped or have a precise shape associated with them, for example, a cube, pyramid, truncated pyramid, or sphere. An agglomerate comprises abrasive particles or grains and a bonding agent. The bonding agent can be organic or inorganic. Examples of organic binders include phenolic resins, urea-formaldehyde resins, and epoxy resins. Examples of inorganic binders include metals (such as nickel), and metal oxides. Metal oxides are usually classified as either a glass (vitrified), ceramic (crystalline), or glass-ceramic. Further information on ceramic agglomerates is disclosed in U.S. Pat. No. 5,975,988 (Christianson) assigned to the assignee of the present invention.

Useful aluminum oxide grains for applications of the present invention include fused aluminum oxides, heat treated aluminum oxides, and ceramic aluminum oxides. Examples of such ceramic aluminum oxides are disclosed in U.S. Pat. Nos. 4,314,827 (Leitheiser, et al.), 4,744,802 (Schwabel), 4,770,671 (Monroe, et al.), and 4,881,951 (Wood, et al.).

The average particle size of the abrasive particle for advantageous applications of the present invention is at least about 0.1 micrometer, preferably at least about 65 micrometers. A grain size of about 100 micrometers corresponds approximately to a coated abrasive grade 220 abrasive grain, according to American National Standards Institute (ANSI) Standard B74.18-1984. The abrasive grain can be oriented, or it can be applied to the backing without orientation, depending upon the desired end use of the coated abrasive backing.

The abrasive particles can be embedded into the make coat precursor by any conventional technique such as electrostatic coating, drop coating, or magnetic coating.

During electrostatic coating, electrostatic charges are applied to the abrasive particles and this propels the abrasive particles upward. Electrostatic coating tends to orient the abrasive particle, which generally leads to better abrading performance. In drop coating, the abrasive particles are forced from a feed station and fall into the binder precursor by gravity. It is also within the scope of this invention to propel the abrasive particles upward by a mechanical force into the binder precursor. Magnetic coating involves using magnetic forces to coat the abrasive particles.

If the abrasive particles are applied by electrostatic coating, then it is preferred that the backing be placed on a drum. The drum serves as a ground for the electrostatic coating process. The proper amount of abrasive particles is then placed on a plate underneath the drum. Next, the drum is rotated and the electrostatic field is turned on. As the drum rotates, the abrasive particles are embedded into the make coat. The drum is rotated until the desired amount of abrasive particles is coated. The resulting construction is exposed to conditions sufficient to solidify the make coat.

Alternately, a charged plate can be used as the ground for the electrostatic process instead of the drum.

Size Coat

A size coat may be applied over the abrasive particles and the make coat such as by roll coating or spray coating. The preferred size coat is a resole phenolic resin filled with a silane treated calcium metasilicate. After the size coat is applied, the size coat is solidified, typically upon exposure to an energy source. These energy sources include both thermal and radiation energy.

Supersize Coat

In some instances it may be preferred to apply a supersize coat over the size coat. The optional supersize coat can preferably include a grinding aid, to enhance the abrading characteristics of the coated abrasive. Examples of grinding aids include potassium tetrafluoroborate, cryolite, ammonium cryolite, or sulfur. One would not typically use more of a grinding aid than needed for desired results. The supersize coat may comprise a binder and a grinding aid.

EXAMPLES

The following non-limiting examples will further illustrate the invention. All parts, percentages, ratios, etc., in the examples are by weight unless otherwise indicated.

Table 1 describes the materials forming the backings for making coated abrasive products according to the invention, comparative backings, coated abrasives according to the invention and comparative coated abrasives.

TABLE 1

| Materials | |
|---|---|
| Designation | Detailed Description of Materials |
| Paper | High tear strength abrasive cylinder paper having a basis weight of 220 g/m$^2$ obtained from FiberMark, Battleboro, Vermont. |
| Nonwoven 1 | Type S-88982 red abrasive belt paper backing having a basis weight of 248 g/m$^2$ obtained from Kimberly-Clark Corporation, Munising, Michigan. |
| Nonwoven 2 | Nylon spunbonded web having a basis weight of 2 oz./yd$^2$ (68 g/m$^2$) available under the trade designation CEREX ™ 2320 from Cerex Advanced Fabrics, Pensacola, Florida. |
| Nonwoven 3 | Pointbonded nylon spunbonded web having a basis weight of 2 oz/yd$^2$ (68 g/m$^2$) available under the trade designation ORION ™ fabric from Cerex Advanced Fabrics, Pensacola, Florida. |
| Combination Backing | Cloth/paper combination web having a basis weight of 390 g/m$^2$ obtained from McKenzie Coating and Finishing, Hyde, United Kingdom. The cloth is a 1/1 plain weave cloth woven with cotton yarns. The paper is thought to be E weight cylinder paper. |
| Adhesive 1 | Thermoplastic ionomer adhesive available under the trade designation SURLYN ™ 1652 from E. I. DuPont de Nemours Company, Wilmington, Delaware. |
| Adhesive 2 | Acrylic emulsion having a solids content of 57.5% and viscosity of 1800–2800 cP @ 25° C. A blend of 99 parts by weight Carbobond ™ 26373 and 1 part by weight Carbopol ™ EP-1, each component being available from B. F. Goodrich Company, Cleveland, Ohio. |
| Antistat | Aqueous dispersion of conductive carbon black, 33% solids obtained from Heucotech Limited, Fairless Hills, Pennsylvania. |
| Barrier Coat | A mixture of 77.5 parts by weight Adhesive 2 and 22.5 parts by weight Antistat, along with sufficient water to reduce the viscosity to 1000 cP. |
| RP1 | Resole phenolic resin, 75% solids a base-catalyzed 1.92:1 aldehyde: phenol condensate. |
| Abrasive particles | Ceramic aluminum oxide abrasive particles obtained under the trade designation Cubitron ™ 321 abrasive from Minnesota Mining & Manufacturing Company, St. Paul, Minnesota. |
| Filler | Calcium carbonate obtained from J.M. Huber Corporation, Quincy, Illinois. |
| $TiO_2$ | Titanium dioxide obtained under the trade designation Ti-Pure R-960 ™ from E.I. DuPont de Nemours, New Johnsonville, Tennessee. |
| Dye | Violet colorant obtained under the trade designation Reactint ™ X80LT from Milliken Chemical Company, Inman, South Carolina. |

Backings 1–5

The particular materials forming laminated Backings 1–5 for the inventive coated abrasives and Comparative Backings 1 and 2 for comparative coated abrasives are described in Table 2. In Table 2, "Paper" is laminated to "Fabric" by "Laminating Adhesive." In the case of Backing 3 only, optional "Additional Fabric" is adhered to "Paper" by a "Second Laminating Adhesive."

Laminated Backings 1–3 and Comparative Backings 1 and 2 were made by the process depicted in FIG. 2 of the drawing. Backing 3 required a second trip because of the additional fabric layer. For Backings 1–3 and Comparative Backings 1 and 2, the laminating adhesive was supplied in the form of a preformed film of 0.0070–0.0075 inch (0.18–0.19 mm) thickness. Backings 4–5 were constructed of the commercially available "Combination Backing" identified in Table 1 laminated to a nonwoven fabric via the process shown in FIG. 4. The barrier coating composition for Backings 1–5 was applied using a #24 Mayer bar coater.

TABLE 2

| Backing No. | Paper | Laminating Adhesive Composition/ Amount | Fabric | Second Laminating Adhesive Composition/ Amount | Add'l. Fabric | Tear Strength mN |
|---|---|---|---|---|---|---|
| 1 | Paper | Adhesive 1 film/ 0.0070–0.0075 in (0.18 mm–0.19 mm) | Nonwoven 2 | None | None | NM[1] |
| 2 | Paper | Adhesive 1 film/ 0.0070–0.0075 in (0.18 mm–0.19 mm) | Nonwoven 3 | None | None | NM |
| 3 | Paper | Adhesive 1 film/ 0.0070–0.0075 in (0.18 mm–0.19 mm) | Nonwoven 3 | Adhesive 1 film/ 0.0070–0.0075 in (0.18 mm–0.19 mm) | Non-woven 2 | NM |
| 4[2] | — | Adhesive 2 (77.5 parts) + Antistat | Combination Backing and | None | None | 19,250 |

TABLE 2-continued

| Backing No. | Paper | Laminating Adhesive Composition/ Amount | Fabric | Second Laminating Adhesive Composition/ Amount | Add'l. Fabric | Tear Strength mN |
|---|---|---|---|---|---|---|
| | | (22.5 parts) 41.8 g/m$^2$ wet add-on | Nonwoven 1 | | | |
| 5[2] | — | Adhesive 2 (77.5 parts) + Antistat (22.5 parts) 150.7 g/m$^2$ wet add-on | Combination Backing and Nonwoven 3 | None | None | 26,790 |
| Comp. 1 | Paper | Adhesive 1 film/ 0.0070–0.0075 in (0.18 mm–0.19 mm) | Nonwoven 2 | None | None | NM |
| Comp. 2 | Paper | Adhesive 1 film/ 0.0070–0.0075 in (0.18 mm–0.19 mm) | Nonwoven 3 | None | None | NM |

[1]"NM" means not measured.
[2]The Paper for this backing was part of the Combination Backing.

Table 3 identifies the various coating compositions used to make coated abrasive products according to the invention and comparative coated abrasive products.

TABLE 3

Identification of Coating Compositions

| Coating Designation | RP1 | Adhesive 2 | Antistat | Filler | Water | $TiO_2$ | Dye |
|---|---|---|---|---|---|---|---|
| Barrier Coat | None | 77.5[3] | 22.5 | None | To reduce viscosity to 1000 cP | None | None |
| Make Coat 1 | 53.0 | None | None | 43.7 | 2.6 | None | None |
| Make Coat 2 | 53.0 | None | None | 43.2 | 3.8 | None | None |
| Size Coat 1 | 74.8 | None | None | 15.2 | 5.4 | 3.8 | 0.8 |
| Size Coat 2 | 70.9 | None | None | 14.4 | 10.4 | 3.6 | 0.7 |

[3]The amounts shown in this table are in weight percent based on 100 weight percent total weight.

Table 4 identifies the elements of various coated abrasive products according to the invention, Examples 1–5, and of various comparative examples, Comparative Examples A, B and F.

TABLE 4

| Ex. | Backing Number | Barrier Coat Dry Wt. g/m$^2$ | Make Coat and Wet Wt. g/m$^2$ | Abrasive Particles Grade and Dry Wt. g/m$^2$ | Size Coat and Wet Wt. g/m$^2$ | Super-Size Coat and Wet Wt. g/m$^2$ |
|---|---|---|---|---|---|---|
| 1 | 2 | 62 | Make 1 104.6 | ANSI grade 80 230.2 | Size 1 138.1 | Size 2 71.1 |
| Comp. A | Comp. 2 | None | Make 1 104.6 | ANSI grade 80 230.2 | Size 1 138.1 | Size 2 71.1 |
| 2 | 1 | 55 | Make 1 54.4 | Grade P150 138.1 | Size 2 83.7 | Size 2 41.9 |
| 3 | 1 | 55 | Make 2 50.2 | Grade P180 133.9 | Size 2 79.5 | Size 2 41.9 |
| Comp. B | Comp. 1 | None | Make 2 50.2 | Grade P180 133.9 | Size 2 79.5 | Size 2 41.9 |
| 4 | 4 | 42 | Make 1 104.6 | ANSI grade 80 230.2 | Size 1 138.1 | Size 2 71.1 |
| 5 | 5 | 76 | Make 1 104.6 | ANSI grade 80 230.2 | Size 1 138.1 | Size 2 71.1 |
| Comp. F | 3 | None | Make 1 104.6 | ANSI grade 80 230.2 | Size 1 138.1 | Size 2 71.1 |

Examples 1–5

Examples 1–5 demonstrate the efficacy of the barrier coated laminated backings to provide superior abrasive articles according to the invention. Coated abrasive articles comprising the barrier coated laminated backings were made of the compositions identified in Table 3. The elements of the various coatings are shown in Table 4.

Coated abrasive articles were prepared according to the following procedure:

A backing was prepared as described above. A coatable mixture for producing a make coating for the backing was prepared according to the amounts shown in Table 3. The make coating was applied in each case via roll coating. Next, graded ceramic aluminum oxide particles were electrostatically coated onto the uncured make coating. Then, the resulting constructions received a precure of 20 minutes at 85° C., followed by 60 minutes at 93° C.

A size coating comprising a conventional resole phenolic resin, a filler, and water as specified in Table 3. was applied over the abrasive particles and the make coated via a two roll coater. The resulting product was cured of at a temperature of 79° C. for 30 minutes and 88° C. for 60 minutes. Similarly, a supersize coating was applied and cured at 99° C. for 25 minutes. Then, the resulting abrasive web was wound into a tight roll and heated at 98° C. for 12 hours. Then, the roll of abrasive web was stored at 60° C. and 35–50% relative humidity for 2 hours to reintroduce moisture that the composition loses when exposed to high temperatures. The resulting coated abrasive articles were then single flexed, that is, passed over a 1.5 inch (3.8 centimeter) diameter roller at an angle of 90° to allow a controlled cracking of the make and size coatings. The coated abrasive articles were then converted into coated abrasive belts by methods well known in the art and the belts were tested.

Comparative Example C

Comparative Example C is a grade 80 coated abrasive article having a backing comprising a conventionally phenolic resin treated Y-weight, 4/1 sateen weave cotton abrasive backing fabric, commercially available from the Milliken Company, Spartanburg, S.C., the coated abrasive product being commercially available under the trade designation 80 3M 970DZ from Minnesota Mining & Manufacturing Company, St. Paul, Minn. The phenolic resin treated backing fabric had a cross direction Elmendorf tear test value of about 14,000 mN.

Comparative Example D

Comparative Example D is a grade P150 coated abrasive article comprising the backing of Comparative Example C, commercially available under the trade designation P150 3M 970DZ from Minnesota Mining & Manufacturing Company, St. Paul, Minn.

Comparative Example E

Comparative Example E is a grade P180 coated abrasive article comprising an X-weight cotton fabric backing, commercially available under the trade designation P180 3M 970DZ from Minnesota Mining & Manufacturing Company, St. Paul, Minn.

TEST METHODS

Tear Test

The tear resistance of coated abrasive articles (and laminated backings therefor) was evaluated by an Elmendorf Tear Test according to the procedure set forth in ASTM D 689-79, Standard Test Method for Internal Tear Resistance of Paper. The data is reported in millinewtons (mN), higher values indicating greater tear resistance. Data was recorded in cross direction (CD), that is orthogonal to the machine direction. Preferably, coated abrasive articles according to the invention demonstrate an Elmendorf tear test value in the cross direction of at least 6000 mN. The tear resistance test results for laminated backings are reported in Table 2 and for coated abrasive articles are reported in Table 5.

Wood Belt Test

Inventive and Comparative abrasive articles in the form of 3"×140" (7.6 cm×355.6 cm) endless belts were evaluated for sanding the edges of wood particle board. Belts to be evaluated were tested on a vertical spindle 900 RPM belt sander comprising a 14 inch (35.6 cm) diameter driven contact wheel, a flat graphite-lubricated backup pad, and provision for urging a particle board workpiece against the belt edgewise to a load of 24 pounds (10.9 kg) for 5-minute intervals, each interval followed by pneumatically assisted retraction of the workpiece from the belt. Test workpieces were preweighed ⅝"×11"×32" (1.6 cm×27.9×81.3 cm) particle board having a 45 pounds per cubic foot (about 220 kg/m$^3$) density, obtained under the trade designation Kor-PINE™ particle board from Willamette Industries, Portland, Oreg. The test belt was mounted on the contact wheels of the sander and tensioned by applying 7 psi (0.5 kg/cm2) to the provided pneumatic cylinder. A particle board workpiece was mounted and secured on the feed mechanism so that the 11" (27.9 cm) dimension is presented to the abrasive belt. The sander was energized and the workpiece mechanically urged against the driven abrasive belt for 5 minutes. The workpiece was dismounted and weighed to determine the mass of the workpiece abraded. Each belt was tested for six 5-minute intervals. The initial cut, final cut, and total cut for the average of 3 test belts are reported in Table 5.

Thompson Grinding Test

The Thompson Grinding Test is used to evaluate abrasive belt performance, as measured by useful life, when operated against a workpiece at a constant predetermined rate of abrasion. This is accomplished by incrementally advancing the interference of, or "downfeeding" a driven abrasive belt against a workpiece.

Abrasive belts were evaluated on a Thompson™ Type C12 grinding machine, available from Waterbury Farrel Technologies, Cheshire, Conn. A 7.6 cm×203 cm endless belt fabricated from the abrasive article to be tested was mounted on the Thompson™ grinding machine. The effective cutting area of the abrasive belt was 4.8 cm ×203 cm. The workpiece was three 1.6 cm×10.2 cm×17.78 cm Kor-PINE (45 pound density, Willamette Industries, Portland, Oreg.) particle board specimens mounted side-by-side on edge on a reciprocating table to present a 4.8 cm×17.78 cm edge to be abraded. The grinding machine was set to drive the abrasive belt at a surface speed of 5600 ft/min (1707 m/min) and to traverse the reciprocating table at 40 ft/min (12.2 m/min). Each reciprocation traversed the table 18 inches (45.7 cm). The incremental downfeed is a fixed value occurring within the range of 3 mil to 110 mil (0.08 mm to 2.8 mm), depending on the abrasive belt grade (Table 5). Test belts were mounted on the grinding machine and the workpieces were mounted on the reciprocating table and an initial interference established between the belt and the workpiece. The grinding machine was energized and the workpiece was brought into contact with the driven abrasive belt for one pass to establish an initial reference surface upon which subsequent downfeed displacements were based. Subsequently, prior to each horizontal pass of the abrasive belt over the presented edge of the workpiece, the vertical interference was increased by the downfeed increment. This grinding/downfeeding cycle was repeated until either the belt or workpiece was burned due to high grinding pressures, or a total of 4.5 inches (11.4 cm) of the workpiece was abraded away. The number of grinding cycles to the endpoint and the final load at the endpoint are reported in Table 5.

Tensile Test

The coated abrasive backing or coated abrasive sample to be tested was converted into a 2.5 centimeter by 17.8 centimeter strip. At least three tensile specimens were cut in the machine direction (referred to herein as MD) of the backing or the belt direction of the abrasive. The specimens were conditioned at least 24 hours in accordance with ASTM Method D 685. Each strip was installed between the jaws of a tensile testing machine known under the trade designation SINTECH™ so that the jaws were initially separated by a space of 10.2 centimeters. The jaws were pulled apart at a rate of 0.5 cm/min until breakage occurred, at which point the force required to rupture was recorded. The test results are reported in Table 6.

Test Results

Results from the various tests are reported in Tables 5 and 6.

The examples demonstrate that abrasive articles with superior performance may be obtained by constructing combination backings with appropriate laminate webs and sealing off the coat side with a barrier coating to retain those properties after application of the abrasive coatings.

The coated abrasive examples according to the invention clearly show the improvements in tear resistance that can be attained compared to conventionally treated abrasive cloth backings. In addition, the improved tear resistance is accomplished with little to no reduction in the tensile properties. Also, the tear resistance is significantly higher when the top layer is treated with a barrier coating, due to reduced penetration into the backing by the cured phenolic abrasive coating. Furthermore, all the inventive examples demonstrate an enhancement in grinding performance over comparatives with cloth backings and laminated backings without barrier coatings. This is especially true in the finer grit abrasive articles, with Example 3 enduring as much as twice the sanding attained by the Comparative Example E (183 vs. 79 passes to the burning endpoint).

TABLE 5

Test Results

| Ex. | Tear Strength mN | Wood Belt Test Initial cut, g. | Wood Belt Test Final cut, g. | Wood Belt Test Total cut, g. | Thompson Downfeed Increments mil (mm) | Thompson# cycles | Thompson Final Load lb (kg) or lb sf |
|---|---|---|---|---|---|---|---|
| 1 | 17,390 | | | | 20 (0.51) | 105 | 8.6 (3.90) |
| | | | | | 40 (1.02) | 53 | 21.3 (9.68) |
| | | | | | 60 (1.52) | 35 | 32.0 (14.6) |
| Comp. A | 11,740 | | | | 20 (0.51) | 105 | 17.9 (8.14) |
| | | | | | 40 (1.02) | 53 | 33.5 (15.2) |
| | | | | | 60 (1.52) | 35 | 44.1 (20.1) |
| Comp. C | 12,990 | | | | 20 (.51) | 105 | 8.50 (3.86) |
| | | | | | 40 (1.02) | 53 | 23.4 (10.6) |
| | | | | | 60 (1.52) | 35 | 31.9 (14.5) |
| 2 | 13,370 | | | | 4 (0.10) | 525 | 20.4 (9.27) |
| | | | | | 6 (0.15) | 180 | 53.0 (24.1) |
| | | | | | 8 (0.20) | 179 | 130 (59.1) |
| Comp. D | | | | | 4 (0.10) | 525 | 56.8 (25.8) |
| | | | | | 6 (.15) | 180 (burned) | 53.0 (24.1) |
| | | | | | 8 (.20) | 179 | 159 (72.1) |
| 3 | | | | | 3 (0.08) | 200 | 8.10 (3.68) |
| | | | | | 4 (0.10) | 285 | 73.1 (33.2) |
| | | | | | 6 (0.15) | 183 | 72.2 (32.8) |
| Comp. B | | | | | 3 (0.08) | 200 | 12.6 (5.73) |
| | | | | | 4 (0.10) | 130 | 64.2 (29.2) |
| Comp. E | 10034 | | | | 3 (0.08) | 200 | 6.90 (3.14) |
| | | | | | 4 (0.10) | 208 | 70.5 (32.1) |
| | | | | | 6 (0.15) | 79 | 74.7 (34.0) |
| 4 | | 788 | 420 | 3391 | 70 (1.78) | 64 | 56.3 (25.6) |
| | | | | | 90 (2.29) | 50 | 60.2 (27.4) |
| | | | | | 110 (2.79) | 41 | 79.5 (36.1) |
| 5 | | 730 | 417 | 3280 | 70 (1.78) | 64 | 49.5 (22.5) |
| | | | | | 90 (2.29) | 50 | 60.8 (27.6) |
| | | | | | 110 (2.79) | 41 | 97.4 (44.3) |
| Comp. C | | 642 | 345 | 2646 | 70 (1.78) | 64 | 59.9 (27.2) |
| | | | | | 90 (2.29) | 50 | 76.4 (34.7) |
| | | | | | 110 (2.79) | 41 | 150.3 (68.3) |
| Comp. F | 61530 | | | | | | |

TABLE 6

| | MD load at break lb/in | MD load at break kg/25 mm |
|---|---|---|
| Backing 4 | 216 | 96.6 |
| Backing 5 | 188 | 84.1 |
| Backing from Comp. C | 257 | 115 |
| Coated Abrasive Ex. 4 | 247 | 111 |
| Coated Abrasive Ex. 5 | 187 | 83.7 |
| Coated Abrasive Comp. Ex C | 268 | 120 |

The present invention has now been described with reference to several embodiments thereof It will be apparent to those skilled in the art that many changes can be made in the embodiments described without departing from the scope of the invention. Thus, the scope of the present invention should not be limited to the structures described herein, but rather by the structures described by the language of the claims, and the equivalents of those structures.

What is claimed is:

1. A coated abrasive product comprising:

a. an abrasive layer;

b. a barrier coating; and c. a relatively stiff, but flexible, backing comprising at least one nonwoven fabric sheet and at least one paper sheet adhesively laminated together by a thermoplastic plastic adhesive material to provide a laminate having at least one major surface provided by said fabric sheet that is coated with said barrier coating to which said abrasive layer is adhered and a second opposite major surface provided by said paper sheet, wherein the backing has an Elmendorf tear test value of at least 10,000 mN.

2. The coated abrasive product of claim 1 wherein said fabric has a thickness of about 0.1 to about 0.4 mm.

3. The coated abrasive product of claim 1 wherein said backing includes a second nonwoven fabric sheet adhesively laminated to said second opposite major surface.

4. The coated abrasive product of claim 1 wherein said adhesive material is an ionomer adhesive.

5. The coated abrasive product of claim 4 wherein said ionomer adhesive material is a zinc salt of an ethylene methacrylic acid copolymer.

6. The coated abrasive product of claim 1 wherein said paper sheet is cylinder paper.

7. The coated abrasive product of claim 1 wherein said fabric has a basis weight in the range of about 17 to about 230 gsm.

8. The coated abrasive product of claim 1 wherein said paper has a basis weight in the range of about 100 to about 400 gsm.

9. The coated abrasive product of claim 1 wherein said barrier coating composition is a heat reactive acrylic latex with carboxyl functionality.

10. The coated abrasive product of claim 1 wherein said abrasive layer comprises a make coat, abrasive granules, a size coat, and, optionally, one or more supersize coats.

11. The coated abrasive product of claim 1 wherein said barrier coating composition includes an additive which makes it electrically conductive.

12. The coated abrasive product of claim 1 wherein said fabric is a spunbonded nonwoven web.

13. The coated abrasive product of claim 1 in the form of an abrasive belt.

14. The coated abrasive product of claim 1 in the form of an abrasive disc.

15. The coated abrasive product of claim 1 wherein said paper sheet includes an additive which makes it electrically conductive.

16. The coated abrasive product of claim 1 wherein said paper has a machine direction tensile strength at break of at least about 40 kg/25 mm and a cross direction tensile strength at break of at least about 16 kg/25 mm.

17. The coated abrasive product of claim 1 wherein said fabric has a tensile strength at break of at least about 50 kg/25 mm.

* * * * *